US006834593B2

(12) United States Patent
Nardone et al.

(10) Patent No.: US 6,834,593 B2
(45) Date of Patent: Dec. 28, 2004

(54) SELF EXTRACTING SUBMUNITION

(75) Inventors: Ralph L. Nardone, Billerica, MA (US); Richard McConville, Melrose, MA (US)

(73) Assignee: Textron Systems Corporation, Wilmington, MA (US)

( * ) Notice: Subject to any disclaimer, the term of this patent is extended or adjusted under 35 U.S.C. 154(b) by 29 days.

(21) Appl. No.: 10/643,433

(22) Filed: Aug. 19, 2003

(65) Prior Publication Data

US 2004/0107861 A1 Jun. 10, 2004

Related U.S. Application Data

(62) Division of application No. 10/008,923, filed on Nov. 16, 2001, now Pat. No. 6,666,145.

(51) Int. Cl.[7] ..... F42B 12/60
(52) U.S. Cl. ..... 102/489; 102/393
(58) Field of Search ..... 102/489, 393, 102/340, 342, 351, 357; 89/1.11

(56) References Cited

U.S. PATENT DOCUMENTS

| | | | | | |
|---|---|---|---|---|---|
| 3,222,675 | A | | 12/1965 | Schwartz | |
| 3,273,834 | A | | 9/1966 | Bower | |
| 3,332,348 | A | * | 7/1967 | Myers et al. | 102/369 |
| 3,818,833 | A | * | 6/1974 | Throner, Jr. | 102/389 |
| 4,172,407 | A | * | 10/1979 | Wentink | 89/1.56 |
| 4,196,669 | A | | 4/1980 | Weidenhagen et al. | |
| 4,273,048 | A | | 6/1981 | Aley et al. | |
| 4,356,770 | A | | 11/1982 | Atanasoff et al. | |
| 4,372,216 | A | * | 2/1983 | Pinson et al. | 102/489 |
| 4,444,117 | A | * | 4/1984 | Mitchell, Jr. | 102/489 |
| 4,488,488 | A | | 12/1984 | Looger et al. | |
| 4,492,166 | A | | 1/1985 | Purcell | |
| RE32,094 | E | | 3/1986 | Atanasoff et al. | |
| 4,583,703 | A | | 4/1986 | Kline | |
| 4,635,553 | A | | 1/1987 | Kane | |
| 4,676,167 | A | | 6/1987 | Huber, Jr. et al. | |
| 4,744,301 | A | | 5/1988 | Cardoen | |
| 4,756,253 | A | | 7/1988 | Herring et al. | |
| 4,829,903 | A | | 5/1989 | Axinger et al. | |
| 4,989,517 | A | | 2/1991 | Adimari et al. | |
| 5,067,410 | A | * | 11/1991 | Murnane et al. | 102/489 |
| 5,225,627 | A | | 7/1993 | Phillips et al. | |
| 5,231,928 | A | | 8/1993 | Phillips et al. | |
| 5,277,116 | A | * | 1/1994 | Axinger et al. | 102/388 |
| 5,540,156 | A | | 7/1996 | Fong | |
| 5,577,431 | A | * | 11/1996 | Kusters | 89/1.51 |
| 5,619,010 | A | | 4/1997 | Holm et al. | |
| 5,679,919 | A | | 10/1997 | Holm et al. | |
| 5,907,117 | A | | 5/1999 | Persson et al. | |
| 2001/0025901 | A1 | | 10/2001 | Frucht | |

FOREIGN PATENT DOCUMENTS

| | | |
|---|---|---|
| FR | 2555731 A | 5/1985 |
| JP | 6-273100 | 6/1994 |

OTHER PUBLICATIONS

Analog Devices, Press Release, Aerojet Awards Mixed–Signal ASIC Development Contract to Analog Devices, Inc. for SADARM Smart Munition, Feb. 12, 2002, pp. 1–2, http://content.analog.com/pressrelease/prdisplay/0.1622.55.00.htmlAnalog Devices.

ArmyLINK News, Innovation + imaginaion + Technical expertise = SADARM, by Spc. Tonya L. Riley–Rodriguez, Feb. 12, 2002, pp. 1–3, http://www.dtic.mil/armylink/news/Mar1997/a19970303sadarm.htmlInnovation + immigination + technical exper . . .

(List continued on next page.)

*Primary Examiner*—Michael J. Carone
*Assistant Examiner*—Troy Chambers
(74) *Attorney, Agent, or Firm*—Wolf, Greenfield and Sacks, P.C.

(57) ABSTRACT

A method and system for extracting and targeting multiple submunitions from a delivery vehicle. Each submunition may be self-extracting, recoil-less extracting, self-spin initiating, and/or sensor fuzed.

31 Claims, 11 Drawing Sheets

OTHER PUBLICATIONS

Chamberlain Manufacturing Corporation, 155mm M898 SADARM, Jan. 17, 2002, pp. 1–2, http://www.cmcscr.org/sadarm.htm 155 mm M898.

DOT&E, FY96 Annual Report, Sense and Destroy Armor (SADARM), Jan. 17, 2002, pp. 1–3 http://www.dote.osd-.mil/reports/FY96/96SADARM.htmlSENSE AND DESTROY ARMOR (SADARM)–FY96.

DOT&E, FY99 Annual Report, Sense and Destory Armor (SADARM), Feb. 12, 2002, pp. 1–7, http://www.dote.osd.mil/reports/FY99/army/99sadarm.htmlSENSE AND DESTROY ARMOR (SADARM)–FY99.

DOT&E, FY00 Annual Report, Sensor Fuzed Weapon (SFW), Feb. 12, 2002, pp. 1–7, http://www.dote.osd.mil/reports/FY00/aiforce/00sfw.htmlSENSOR FUZED WEAPON (SWF)–FY00.

* cited by examiner

SELF EXTRACTING SUBMUNITION

This application is a division of prior application Ser. No. 10/008,923, filed on Nov. 16, 2001, entitled SELF EXTRACTING SUBMUNITION and now pending.

BACKGROUND OF THE INVENTION

1. Field of the Invention

This invention relates to a method, a system, and a device for extracting and targeting a submunition mounted on or in a multiple submunition delivery vehicle.

2. Background of the Invention

Typically, air-to-ground munitions such as gravity bombs, glide bombs, and cluster bombs, dispensed from dispensers, glide bomb units, or other delivery vehicles, are dropped in a pattern to blanket a target area. This method is used to increase the probability that an individual bomb, or submunition in the case of cluster bomb, will encounter, engage, and destroy targets within the target area. Further, in the case of the cluster bomb, the submunitions are ejected in a dispersion pattern depending upon the nature of the ejection mechanism mounted to the carrier. Even further, since the submunitions are armed upon being dispensed from the cluster bomb or other carrier, they often remain unexploded, armed, and lethal when they impact the ground, given that they did not encounter and engage a target. This overall approach to engaging one or more targets with many individual munitions or dispensed submunitions is often referred to as an "area attack" and is a statistical methodology to defeating targets.

Area attack is contrasted with what is often referred to as "precision attack," which typically uses one precision-guided munition to engage each target individually. Precision attack yields a higher percentage of kills per munition, but at a substantially higher cost due to the use of precision guidance and control on each munition.

SUMMARY OF THE INVENTION

This invention is a form of precision attack with multiple submunitions in a delivery vehicle. Each submunition may be self-extracting, recoil-less extracting, self-spin initiating, and/or sensor fuzed.

In one embodiment of the invention, a method for extracting multiple submunitions from a delivery vehicle is shown. The method comprises the steps of entering a target acquisition area, initiating at least one extraction motor of at least one submunition, and extracting at least one submunition from the delivery vehicle with the at least one extraction motor. The method further comprises the steps of initiating a submunition sensor subsystem of the at least one submunition, acquiring a target with the at least one submunition sensor subsystem, and fuzing a weapon on board the at least one submunition in response to the submunition sensor subsystem.

In another embodiment of the invention, a method for extracting multiple submunitions from a delivery vehicle is shown. The method comprises the steps of entering a target acquisition area and forming at least one through-port in the delivery vehicle. The method further comprises the steps of initiating at least one extraction motor of at least one submunition, forming an extraction plume from the at least one extraction motor through the at least one through-port, and extracting at least one submunition from the delivery vehicle.

In yet another embodiment of the invention, a method for extracting multiple submunitions from a delivery vehicle is shown. The method comprises the steps of entering a target acquisition area, initiating at least one extraction motor of at least one submunition, and extracting at least one submunition from the delivery vehicle. Then after the step of extracting, the method comprises the steps of initiating a spin-motor of the at least one submunition and spinning the at least one submunition.

In one embodiment of the invention, a method for extracting multiple submunitions from a delivery vehicle is shown. The method comprises the steps of entering a target acquisition area and forming at least one through-port in the delivery vehicle. The method further comprises the steps of initiating at least one extraction motor of at least one submunition, forming an extraction plume from the at least one extraction motor through the at least one through-port, and extracting at least one submunition from the delivery vehicle. After the step of extracting, the method further comprises the steps of initiating a spin-motor of the at least one submunition and spinning the at least one submunition. The method further comprises the steps of initiating a submunition sensor subsystem of the at least one submunition, acquiring a target with the at least one submunition sensor subsystem, and fuzing a weapon on board the at least one submunition in response to the submunition sensor subsystem.

In another embodiment of the invention, a munition system is provided. The munition comprises a powered or unpowered glide bomb or missile vehicle having a main body portion and at least two submunitions mounted within the main body portion. Each submunition has at least one extraction motor having at least one ejection port aligned with at least one flow through-port of the main body portion.

In yet another embodiment of the invention, a method for deploying submunitions from a delivery vehicle is provided. The method comprises the steps of extracting at least one submunition from the delivery vehicle by extraction means other than an extraction motor and spinning the at least one submunition. The method further comprises the steps of initiating a submunition sensor subsystem, acquiring a target, and fuzing a weapon onboard the at least one submunition.

Other objects and features of the invention will become apparent from the following detailed description when taken in connection with the accompanying drawings. It is to be understood that the drawings are designed for the purpose of illustration only and are not intended as a definition of the limits of the invention.

BRIEF DESCRIPTION OF THE DRAWINGS

The various embodiments of the invention will now be described, by way of example, with reference to the accompanying drawings, in which.

DETAILED DESCRIPTION

The invention described herein provides a method and mechanism for a precision attack delivery vehicle to dispense multiple submunitions such that they will selectively engage targets within a target area. Each submunition may be self-extracting, recoil-less extracting, self-spin initiating, and/or sensor fizzed, thereby gaining the advantage of multiple target kills per carrier munition with a near zero occurrence of armed lethal submunitions remaining on the ground after the attack.

Figure 1:
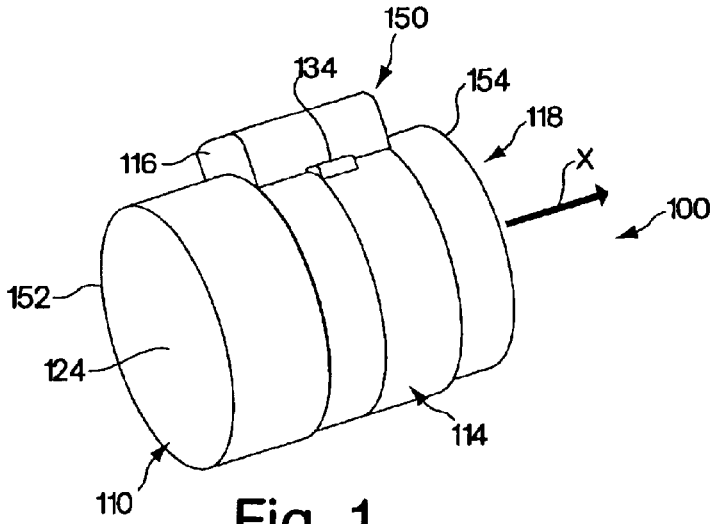
FIG. 1 is a perspective view of a submunition embodiment of the invention.

FIG. 1 illustrates an example submunition 100 for precision engagement of military targets on the ground, which may be fixed, mobile, or relocatable. The submunition package is preferably substantially cylindrical in shape, and more preferably with a diameter of approximately 5 inches, to enhance use within existing delivery vehicle delivery systems currently used by military forces. Each submunition may include a warhead 110, an extraction motor 112 (shown in FIG. 5), a motor assembly 114, a submunition sensor subsystem 116 which may be mounted in a submunition sensor housing 150, a submunition processor subsystem 134, and in one embodiment of the invention, an orientation and stabilization system 126 (shown in FIG. 6B) which may be mounted in an orientation stabilization system housing 118 and which may be initiated after extraction from the delivery vehicle.

Figure 4:
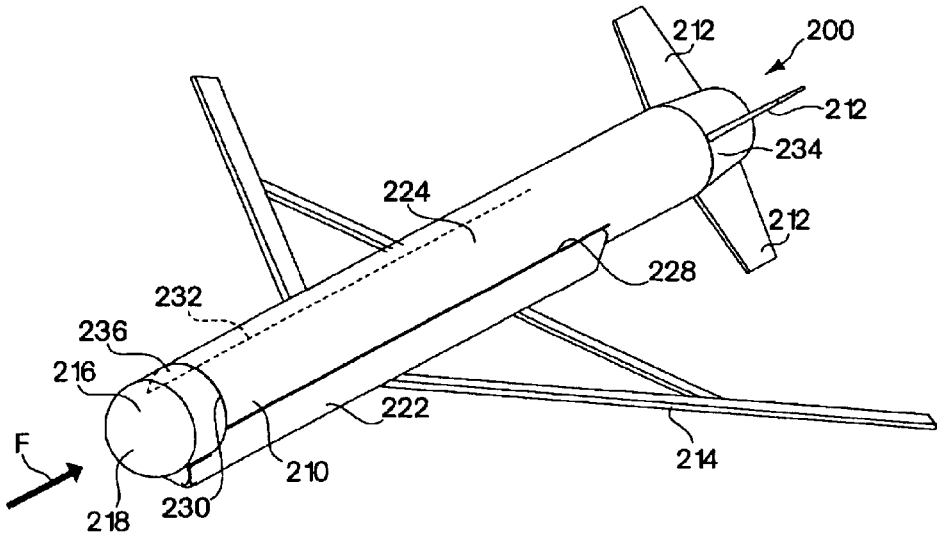
FIG. 4 is a perspective view of the delivery vehicle of one embodiment of the invention.

FIG. 4 illustrates an example delivery vehicle 200 for transport and delivery of multiple submunitions 100. The delivery vehicle 200, preferably a precision gliding missile or bomb, has a main body portion 210 that is preferably cylindrical to form a bay to hold the submunitions 100 before release into the target area. The gliding delivery vehicle 200 has control tail fins 212 and may also include a lift wing 214 attached to the body portion 210 of the delivery vehicle 200. The wing and/or tail fins allow the delivery vehicle 200 to be air dropped sufficiently far from the target area to provide standoff protection for the delivery aircraft (not shown), and to then glide over the target area. Those skilled in the art will recognize alternative embodiments and combinations are appropriate to deliver, stabilize, control, and/or lift the delivery vehicle 200.

Figure 3:
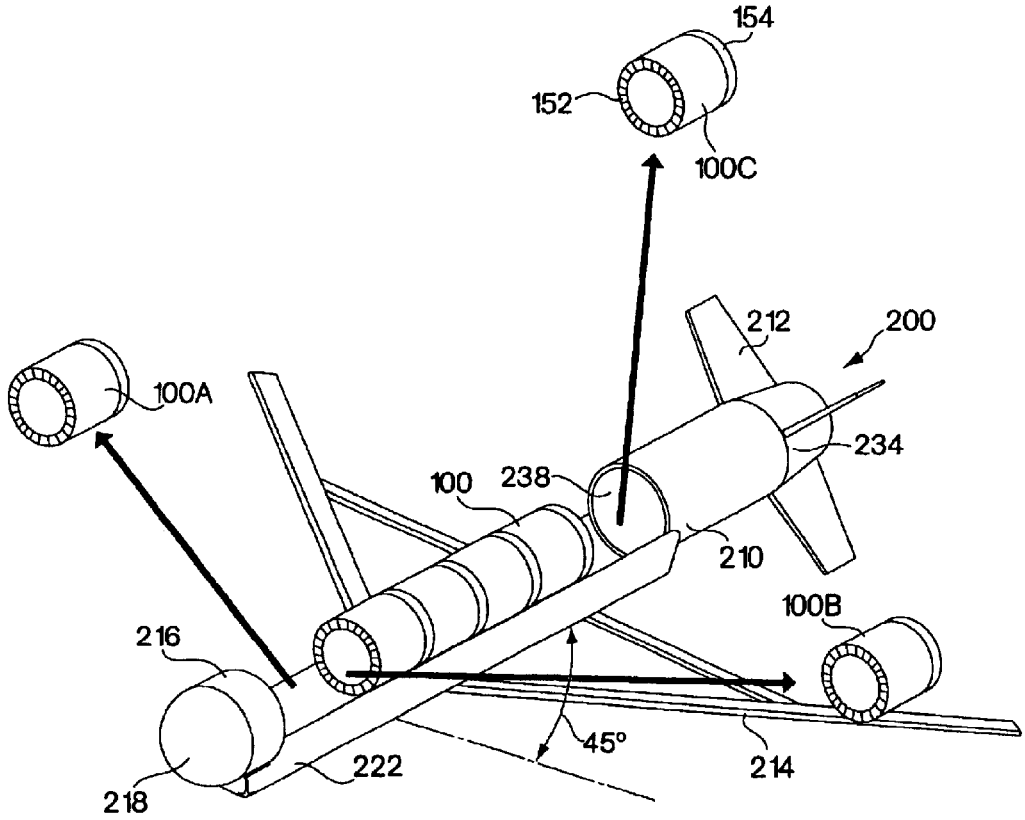
FIG. 3 is a perspective view illustrating extraction of an embodiment of the submunition from a delivery vehicle.
Figure 10:
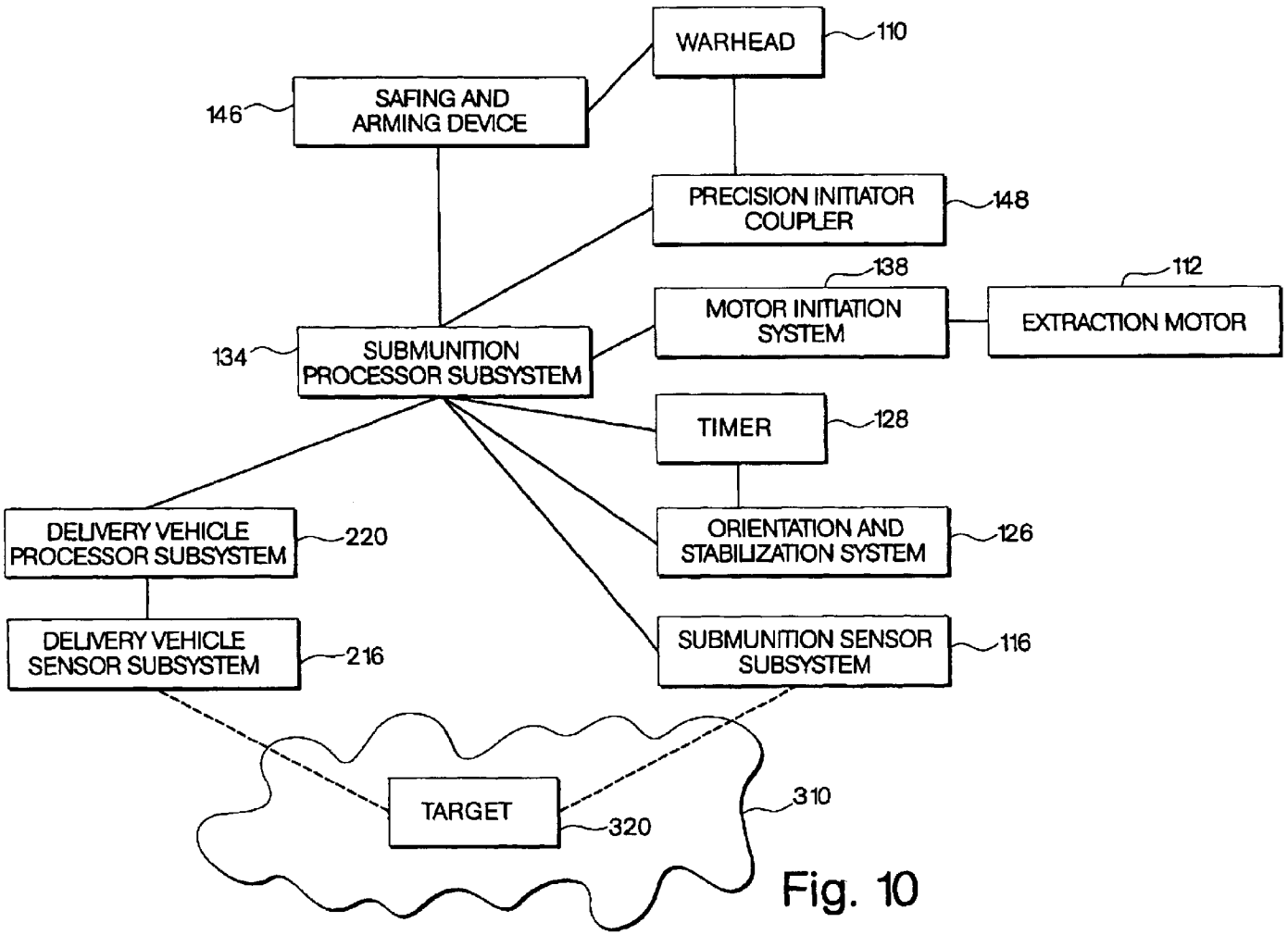
FIG. 10 is a schematic view of an embodiment of the invention.

The delivery vehicle 200 further includes a delivery vehicle sensor subsystem 216 preferably located in the nose 218 of the delivery vehicle 200. This delivery vehicle sensor subsystem 216 can embody one or more sensing modes such as electro-optical, Global Positioning System receiving, radar, LIDAR and/or LADAR and a suitable signal/image processor to detect military targets in the background clutter of the target area and distinguish military from non-military objects or vehicles. The delivery vehicle sensor subsystem 216 detects and locates targets within the target area and may further have a delivery vehicle processor subsystem 220 (shown in FIG. 10) to process the sensor signals to help recognize and/or distinguish military targets and civilian targets. As shown in FIG. 10, the delivery vehicle sensor subsystem 216 communicates with the delivery vehicle processor subsystem 220 of the delivery vehicle 200 and determines when a target area 310 (shown in FIG. 10) and/or a target 320 is within range of the possible flight path of the submunition 100 from the delivery vehicle 200. When the target area 310 is in range, a cover 224 of the delivery vehicle 200 may open from the main body portion 210 to reveal the multiple submunitions 100 mounted inside the main body portion 210 as shown in FIG. 3.

In one embodiment of the invention shown in FIG. 4, an opening 238 (shown in FIG. 3) is formed in the main body portion by activating a linear shaped charge mounted in a substantially U-shape on the walls of the main body portion 210. One side 228 of the opening 238 is formed by the linear shaped charge running longitudinally down the side of the cylindrical body portion from the rear 234 of the delivery vehicle 200 toward the front 236 of the delivery vehicle 200. The base 230 of the opening 238 is formed by the linear shaped charge running over the circular portion of the body near the front 236 of the delivery vehicle 200, and the third side 232 of the opening 238 is formed by the linear shaped charge running along the longitudinal side of the body portion to the rear 234 of the delivery vehicle 200. When the linear shaped charge is activated, the walls of the delivery vehicle body are sheered and the ram air of the flight path of the delivery vehicle 200, shown by arrow F, may lift and peel back the U-shaped cover 224 formed by the linear shaped charge sheering the main body portion walls. As the cover 224 is bent back by the ram air of the delivery vehicle's forward velocity, the cover 224 is sheered off of the main body portion 210 at the fourth side of the opening at the rear 234 of the delivery vehicle to reveal the submunitions 100 mounted on the remaining base 222 of the main body portion 210 as shown in FIG. 3. The main body portion 210 walls may be shaped and formed to include a weakened joint to assist sheering of the walls by the linear shaped charge and/or the ram air of the delivery vehicle 200. In one embodiment of the invention, the opening is approximately 270–315 degrees from the cross-sectional view of the cylindrical walls of the main body portion such that when the opening is revealed, and approximately 90–45 degrees remain of the cylindrical body as a base 222, forming a stable mounting platform for the submunitions 100 when the cover 224 is removed. Those skilled in the art will recognize that other opening shapes and methods of revealing the opening are appropriate.

Figure 8A:
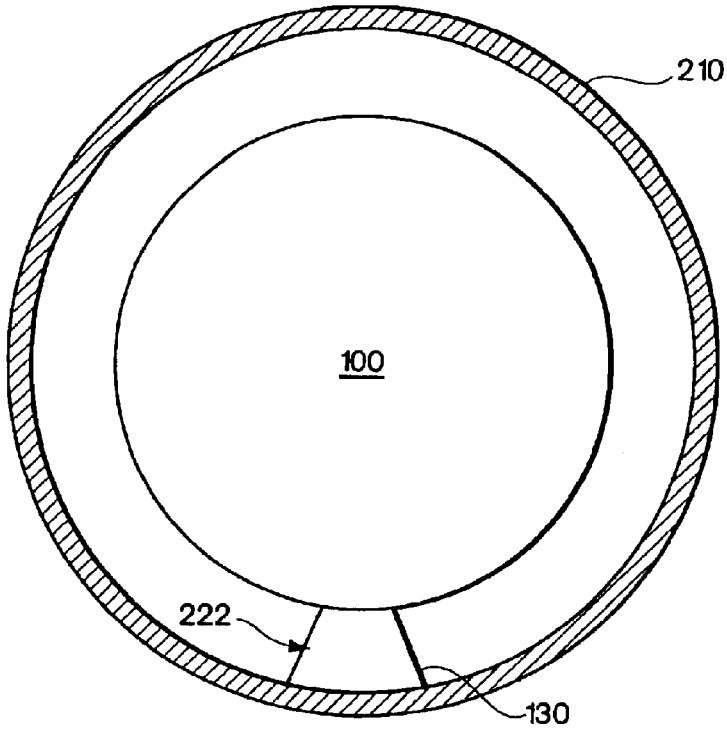
FIG. 8A is a cross-sectional view of an attachment device for submunitions in a delivery vehicle.
Figure 8B:
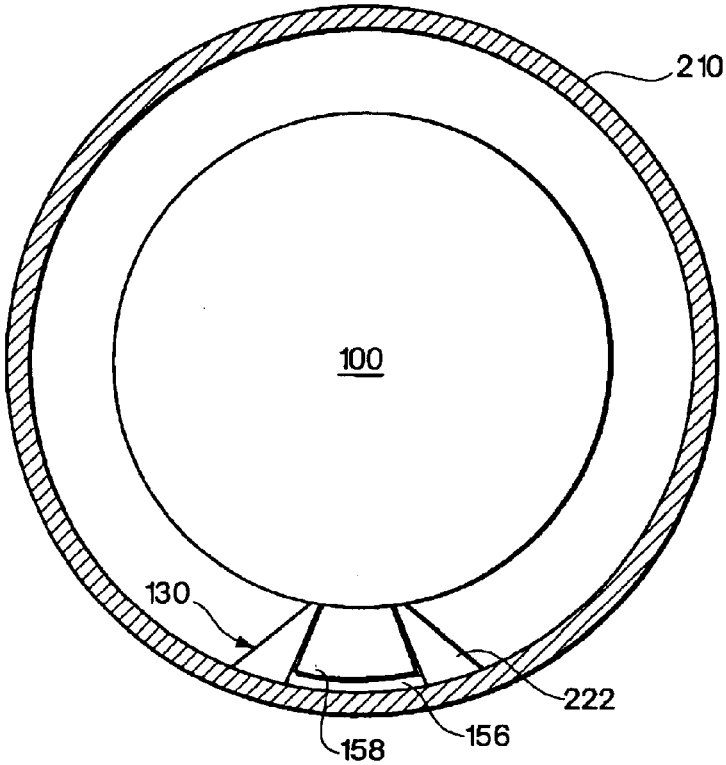
FIG. 8B is a cross-sectional view of an alternative attachment device for submunitions in a delivery vehicle.
Figure 8C:
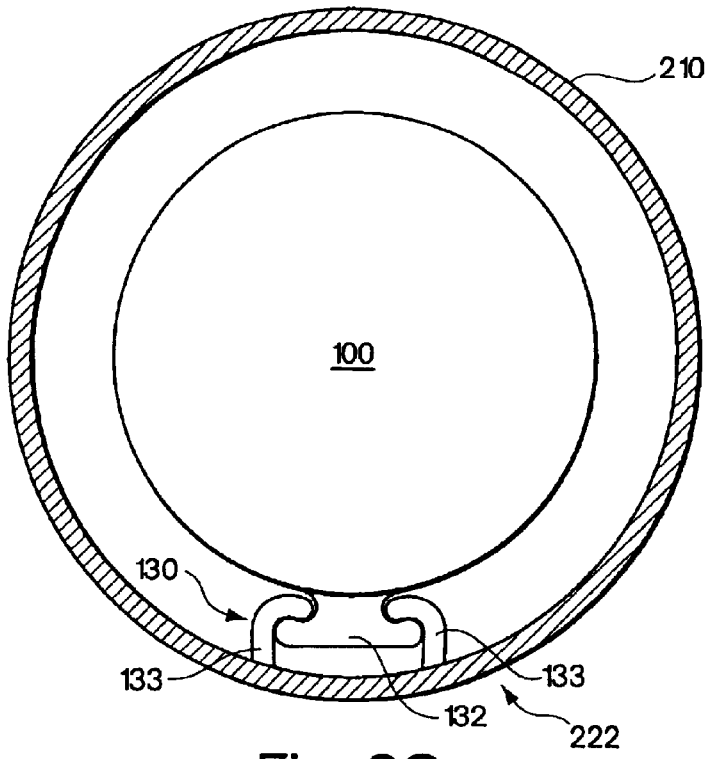
FIG. 8C is a cross-sectional view of another attachment device for submunitions in a delivery vehicle.

The submunitions 100 may be releasably secured to the base 222 (see FIG. 3) such that each submunition 100 is stably mounted to the base 222 before extraction of the submunition 100. The submunition 100 may be released and extracted from the delivery vehicle 200 when the submunition extraction motor 112 is initiated. In one embodiment of the invention shown in FIG. 8A, the submunition 100 may be attached to the base 222 with a dovetail device 130. The dovetail device 130 may be sheered open under the forces of the extraction motor 112 during extraction. In another embodiment shown in FIG. 8B, the dovetail device 130 may include a mortise 156 and tenon 158. The mortise 156 and/or tenon 158 may be sheered open under the forces of the extraction motor 112 during extraction. In an alternative embodiment of the invention, the dovetail device 130 may be a snap lock system frictionally holding the submunition 100 to the base 222. The extraction motor 112 is able to overcome the friction force at extraction to separate the submunition 100 from the delivery vehicle 200. For example, the snap lock 133 as shown in FIG. 8C may be attached to the base 222 of the delivery vehicle 200 and frictionally attached to a mounting tongue 132 on the external surface of the submunition 100. Alternatively, the mounting tongue 132 may be mounted on the inside surface of the delivery vehicle base 222 and the snap lock 133 may be mounted on the external surface of the submunition 100. The dovetail device 130 attached to the delivery vehicle 200 may be one dovetail for all submunitions mounted therein, a single dovetail for each submunition mounted therein, or multiple dovetails may be provided for each submunition mounted therein.

In one embodiment of the invention, eight submunitions 100 are mounted back 154 to front 152 (FIG. 3) within the main body portion 210 of the delivery vehicle 200, although, for clarity, only seven submunitions are shown. Preferably, the submunitions 100 are spaced to maximize available delivery vehicle payload space while simultaneously insuring that non-extracted submunitions are not disturbed or damaged during extraction of another submunition 100. Typically, at least 2 spaces may provide access to internal suspension struts (not shown) of the delivery vehicle 200. The number and mounting formation of the submunitions 100 in the main body portion 210 can be modified for particular mission, carrier, aircraft, and submunition selection factors. Preferably, submunitions are extracted in the order of the rearward-most submunition towards the front to maintain air flow over the substantially cylindrical portion formed by the forward-most submunitions and to maintain a forward center of gravity to increase stability of the delivery vehicle 200. However, those skilled in the art will recognize that alternative extraction sequences may be preferable in differing operational scenarios.

Referring to the schematic view of FIG. 10, the delivery vehicle sensor subsystem 216 of the delivery vehicle 200 detects targets within the target area 310. When a target 320 is within range, the delivery vehicle processor subsystem 220 assigns one of the multiple submunitions 100 mounted within the delivery vehicle 200 to the target 320 detected by the delivery vehicle sensor subsystem 216. The delivery vehicle processor subsystem 220 may then send a message to the appropriate submunition processor subsystem 134 to initiate the extraction motor 112. Those skilled in the arts will recognize that many systems are available for the delivery vehicle processor subsystem 220 and/or submunition processor subsystem 134 including, computers with an input, processor, memory, and/or output system.

The submunition 100 may be propelled in one of many directions from the delivery vehicle 200 as determined by the target location relative to a variety of factors such as the height, speed, location, and distance of the delivery vehicle 200. The submunition 100 may thrust to the left of the delivery vehicle 200 to propel the submunition 100 to the right of the delivery vehicle 200, may thrust to the right of the delivery vehicle 200 to propel the submunition 100 to the left of the delivery vehicle 200, may thrust substantially down to propel the submunition 100 upwards of the delivery vehicle 200, or may thrust up to propel the submunition 100 downward. Those skilled in the art will recognize that varying thrust direction as well as thrusting through any combination of directions may be chosen to meet particular mission parameters.

In the embodiment of the invention shown in FIG. 3, the submunition 100 may be launched left, right, or straight up from the delivery vehicle, for example, as shown at 100A, 100B, and 100C. The delivery vehicle processor subsystem 220 preferably determines which direction (left, right, or up) of extraction for the submunition 100 will maximize target engagement and communicates that information to the appropriate submunition 100. Alternatively, the delivery vehicle processor subsystem 220 may communicate the target location to the submunition 100 and the submunition processor subsystem 134 may determine the appropriate extraction direction. To release the submunition 100 from the delivery vehicle 200 as shown in FIGS. 2B and 3, the extraction motor 112 may thrust to the left of the delivery vehicle 200 to propel the submunition 100A to the right of the delivery vehicle 200, may thrust to the right to propel the submunition 100B to the left of the delivery vehicle 200, or may thrust substantially down to propel the submunition 100C upwards of the delivery vehicle 200. Preferably, the left and right extraction of a submunition 100 has an approximately 45 degree throw angle, measured from the local horizontal of the delivery vehicle 200, to maximize lateral range of the submunition 100 in its flight path from the delivery vehicle. Alternatively, the delivery vehicle 200 may maneuver to direct the proper extraction direction of the submunition 100 mounted therein.

Figure 5:
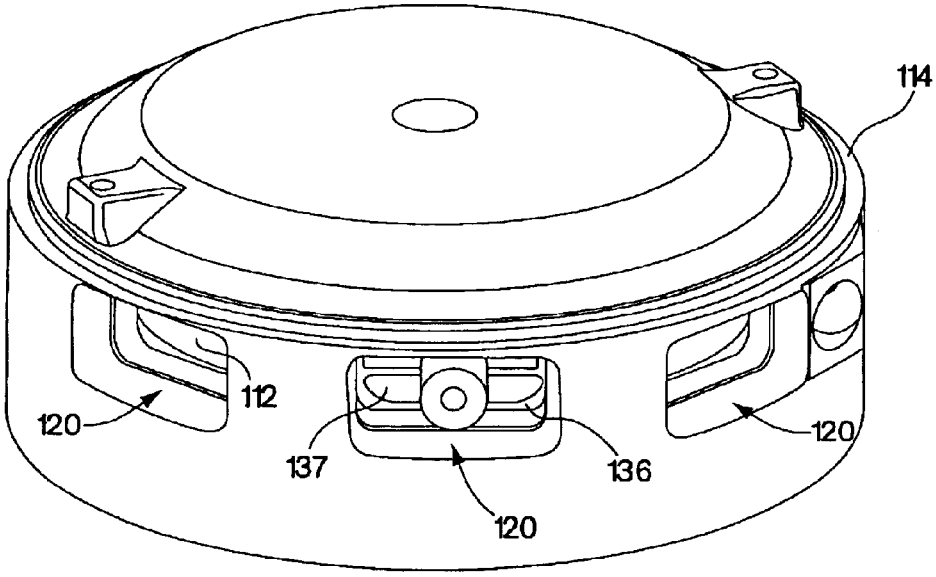
FIG. 5 is a perspective view of a rocket motor of an embodiment of the invention.
Figure 9:
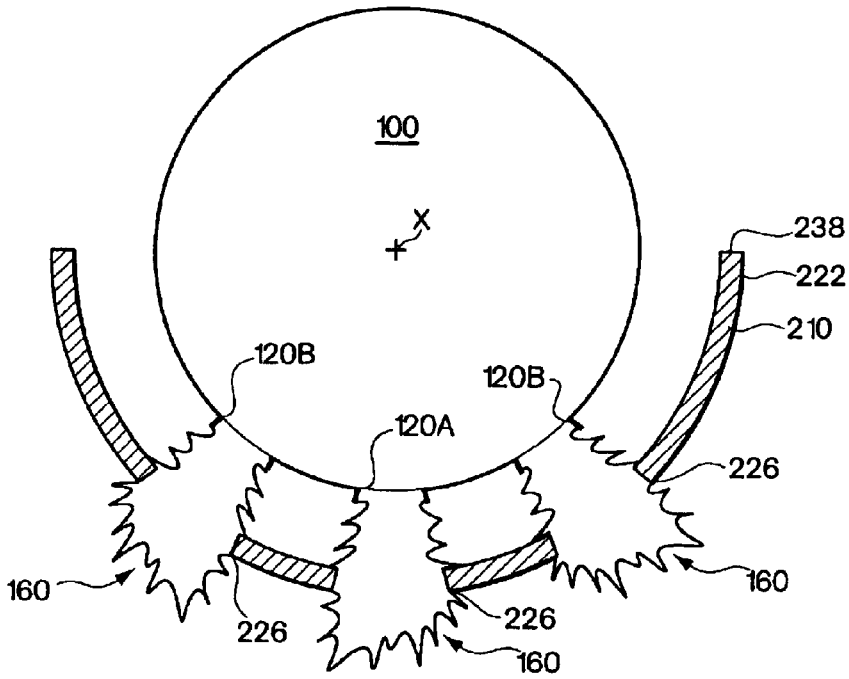
FIG. 9 is a cross-sectional view of a submunition mounted in one embodiment of a delivery vehicle.

The motor assembly 114 has at least one ejection port 120, and preferably three ejection ports 120 as shown in FIGS. 2B, 5, and 9. The ejection ports 120 may be shaped and sized, as is well-known in the art, to allow the extraction motor 112 to form a sufficient thrust plume 160 to release and propel the submunition 100 from the delivery vehicle 200. The surface area of the opening of the ejection port 120 is driven by the design parameters of the motor assembly 114 including avoiding over-pressure in the motor assembly 114. The shape of the ejection port 120 may be driven by its placement on the motor assembly 114 of the submunition 100. In one embodiment of the invention shown in FIG. 5, each ejection port 120 is substantially rectangular preferably having dimensions of 0.75 inches by 1.25 inches and is placed around the lower 90° of the circumference of the motor assembly 114 or base 222.

Preferably, each ejection port 120 is placed on the circumference of the submunition motor assembly 114 and aimed to create the proper throw angle when the submunition 100 is extracted. The ejection port 120 may act as a nozzle to form and direct the motor assembly 114 thrust plume 160. The ejection port 120 preferably directs the thrust plume 160 radially outward from the submunition 100; alternatively, the ejection port 120 may be angled, i.e. not normal, to the circumferential surface of the submunition motor assembly. Preferably, the ejection port 120 is placed and angled to direct the thrust plume and its associated force vector through the center of gravity X, shown in FIGS. 2B and 9, of the submunition 100. Thus, the ejection port 120 is preferably placed longitudinally along the side of the submunition 100 to be in the same plane as the center of gravity of the submunition 100 and to direct the thrust plume 160 along a line through the center of gravity, approximately at the center of the cross-section of the submunition 100. In one embodiment of the invention as shown in FIGS. 2B and 9, the ejection port 120A is placed at the bottom of the submunition 100 to enable the submunition 100 to thrust substantially downward to extract upward from the delivery vehicle 200. Ejection ports 120B are placed at approximately 45° from ejection port 120A to provide a 45° throw angle to the left or right of the submunition 100. Although all three ejection ports 120A, 120B are shown with a thrust plume 160 in FIGS. 2B and 9, preferably, only one ejection port 120 is opened and used per submunition.

Preferably, only one ejection port 120 is open at extraction to allow the thrust plume 160 to form in the appropriate direction (left, right, down, or up). Thus, any remaining ejection port(s) 120, not used by that particular submunition 100, remain sealed to prevent a thrust plume 160 from forming through the additional, available ejection port(s) 120. Alternatively, the motor assembly 114 may form a thrust plume 160 through multiple ejection ports 120 to create the proper throw direction of the submunition 100 in relation to the delivery vehicle 200 and the appropriate target. The motor assembly 114 may form a thrust plume 160 through multiple ejection ports 120 at substantially the same time to prevent random offset of the submunition flight path, allowing the thrust plumes 160 to provide further indexing of the flight direction for the flight path of the submunition 100. Additionally or alternatively, the motor assembly 114 may thrust through multiple ejection ports 120 sequentially to create the proper flight path. Those skilled in the art will recognize that any combination of ejection port thrust profiles thrusting simultaneously or sequentially may be used to meet differing operational parameters.

Referring to FIG. 5, an embodiment of the invention is shown wherein the ejection ports 120 may be sealed with port plugs 136 to prevent the thrust plume 160 from forming through the inappropriate ejection ports 120. The port plugs 136 may be explosive plugs, such that the appropriate ejection port 120 is opened by exploding the appropriate port plug 136 in only the appropriate direction (left, right, down, or up). The remaining port plugs 136 remain sealed in their respective ejection ports 120 to prevent thrust plumes 160 from forming therethrough. The explosive port plug 136 may also initiate the extraction motor 112 housed in the motor assembly 114. The appropriate port plug 136 may be initiated, e.g., exploded, in one embodiment of the invention, with a motor initiation system 138 (FIG. 10) under control of the delivery vehicle processor subsystem 220 of the delivery vehicle 200, or preferably, the submunition processor subsystem 134 of the submunition 100. The motor initiation system 138 may include a laser initiated photodiode and pyrotechnics. A laser signal initiated by the submunition processor subsystem 134 (FIG. 10) may activate the photodiode which may then in turn explode the appropriate port plug pyrotechnics, which may then open the ejection port 120 as well as may initiate the extraction motor 112. Those skilled in the art will recognize many sealing and/or initiator devices and methods, such as a squib or an electronic initiator may be appropriate to achieve reliability, force, and time design factors.

The ejection port 120 may also include a baffle 137 which may be separate from or integrally formed with the port plug 136. The baffle 137 may hold the propellant in the motor assembly 114 before and/or after the port plug 136 is released and before the propellant is burned or exploded. Those skilled in the art will recognize that many structures are appropriate for the baffle 137 including, but not limited to, a screen and a door.

The extraction motor 112 preferably can propel an approximately 12 pound submunition and provide a 100 feet per second lateral velocity. The extraction motor 112 is preferably a combustion rocket motor and, more preferably, provides approximately a 20–30 millisecond fast-burn thrust from the delivery vehicle 200. Preferably, the extraction thrust forces are sufficient to accelerate and propel the submunition 100 from the delivery vehicle 200, but not create enough pressure to open the uninitiated port plugs 136. Thus, the extraction force pulse may be a function of the ejection port 120 placement and size, the propellant used, and strength and materials of the submunition 100 and port plugs 136. Those skilled in that art will recognize that many systems are appropriate for the extraction motor 112 including combustion rockets using a variety of solid and/or liquid fuels, and/or gas out-letting.

To ensure that the extraction/propulsion forces of the extraction motor 112 of each submunition 100 do not substantially inhibit the planned glide path of the delivery vehicle 200, the base 222 of the delivery vehicle body portion 210 may include a through-port 226 shown in FIGS. 2B and 9. When the extraction motor 112 is initiated, the thrust plume 160 projects through the ejection port 120 of the submunition 100, through any space between the submunition 100 and the delivery vehicle walls, and through the through-port 226 of the walls of the base 222. Thus, the extraction thrust plume 160 will not substantially impinge on the walls of the body portion of the delivery vehicle 200, but rather pass through these walls, which are preferably 0.1 inches thick, and thereby substantially and/or completely avoid perturbation of the existing glide path of the delivery vehicle 200. Each through-port 226 of the delivery vehicle 200 is substantially aligned with each ejection port 120 of the submunition 100 when the submunition 100 is mounted within the delivery vehicle 200. Thus, the dovetail attachment system 130 (FIG. 8A) not only maintains submunition 100 placement in the delivery vehicle 200 after the opening is revealed, but also, maintains alignment of the through-ports 226 of the body portion with the ejection ports 120 of each submunition 100 before extraction from the delivery vehicle 200 and may also space the submunition 100 from the walls of the delivery vehicle 200 in one embodiment, this space is 0.25 inches.

The through-ports 226 are constructed and arranged in the walls of the delivery vehicle 200. The through-ports 226 may be open during the entire flight path of the delivery vehicle 200. Alternatively, the through-ports 226 may be opened or revealed at an appropriate time before extraction with devices known in the art including sliding doors, hinged doors, linear shaped charges, and weakened joints used alone or in any combination. Additionally or alternatively, the through-ports 226 may be opened or revealed by the force of the thrust plume 160.

The through-ports 226 may be shaped and sized to approximately match the associated ejection port 120 and/or thrust plume 160 shape, size, and direction. Preferably, the through-ports 226 are shaped and sized slightly larger than the associated ejection port 120 to allow substantially free passage of the expanding thrust plume 160. Alternatively, the through-port 226 may be shaped to form a slot to meet the estimated thrust plume flow 160 over time as the submunition 100 is extracted. In another embodiment of the invention, the base 222 may be constructed and arranged to allow the opening 238 (FIGS. 3 and 9) to also act as the through-port 226 for thrust plumes 160B. Thus, the through-port 226 may be the opening 238.

Figure 2A:
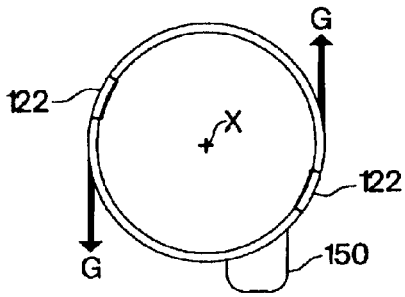
FIG. 2A is a sectional view illustrating possible forces as applied by spin thrusters in an embodiment of the invention.
Figure 2B:
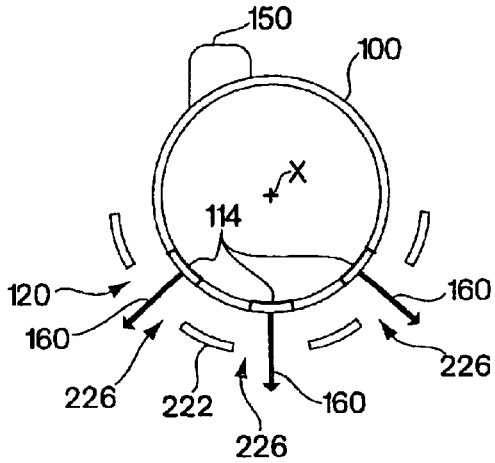
FIG. 2B is a sectional view illustrating possible forces as applied by ejection thrusters in an embodiment of the invention.

Referring to FIG. 2A, it can be seen that after extraction from the delivery vehicle 200, the submunition 100 may be spun up about the principal axis X of the submunition to stabilize the submunition 100 during its ballistic flight toward the target. The spinning of the submunition 100 is preferably created by moment thrusters 122. Preferably, two moment thrusters 122 are diametrically opposed about the center of gravity of the submunition 100 to create a stabilized spin. Preferably, the moment thrusters 122 create a spin of approximately at least 10 hertz in approximately 1–2 milliseconds to initialize aerodynamic and gyroscopic stability of the submunition 100 as it enters and exits the laminar air flow around the delivery vehicle 200. The outside flow field of the delivery vehicle 200 varies with many factors including the dimension, design, and velocity of the delivery vehicle 200.

Alternatively, the moment thrusters 122 may initially create a spin that is not only sufficient to initialize aerodynamic and gyroscopic stability, but also to achieve a spin rate appropriate to deploy an orientation and stabilization system 126; in one embodiment, this spin rate is approximately 20–30 hertz. Alternatively, the moment thrusters 122 may create the initial spin for aerodynamic and gyroscopic stability and an additional spin motor at a later time may achieve the spin rate appropriate to deploy the orientation and stabilization system 126 described below.

In one embodiment of the invention shown in FIG. 2A, the moment thrusters 122 are thrust ports on the side of the submunition package, allowing a combustion rocket to create the moment force with thrust plumes substantially tangential to the side walls of the submunition 100 indicated by the arrows G. Preferably, spin-up occurs directly after the extraction burn is completed, when the submunition 100 is approximately clear of the laminar flow of the delivery vehicle 200. In one embodiment of the invention, the moment thrusters 122 are activated by a second stage of the extraction motor 112. The first stage of the extraction motor 112 supplies the extraction force through the ejection port(s) 120 of the submunition 100. The second stage provides the moment force to spin-up the delivery vehicle 200 through the moment thrusters 122 to achieve aerodynamic and gyroscopic stability, and also preferably achieve a sufficient spin rate to later deploy an orientation and stabilization system 126.

Alternatively, spin-up of the submunition 100 may be achieved with gas out-letting or a mechanical device such as fins on the submunition 100 or a strap attached to the delivery vehicle 200 and wound around the submunition 100 and which would roll the to submunition 100 at extraction. Such a strap spin system is described in U.S. Pat. No. 4,356,770 to Atanasoff et al., which is assigned to the same assignee as this invention, and incorporated entirely by reference herein.

As the submunition 100 approaches its assigned target 320, the submunition processor subsystem 134 on the submunition 100 may activate a submunition orientation and stabilization system 126 to counteract at least the horizontal, and preferably also vertical, movement of the submunition 100 due to the extraction velocity and the initial glide velocity gained from the delivery vehicle 200. Alternatively, the submunition 100 may not include such a stabilization and orientation system. Thus, the submunition flight path may be dependent only on the extraction direction, velocity, and acceleration and factors such as wind, lift, and drag.

The submunition sensor subsystem 116 may communicate with the submunition processor subsystem 134 to control initiation and operation of the submunition orientation and stabilization system 126. In one embodiment of the invention, the submunition processor subsystem 134 may activate the submunition orientation and stabilization system 126 only after the submunition sensor subsystem 116 acquires a target 320, and in a further embodiment of the invention, only after the acquired target 320 is properly within range of the submunition 100.

Alternatively, the delivery vehicle processor subsystem 220 may determine the proper free flight time after extraction for the submunition 100 based on at least the estimated free flight speed of the submunition 100, the estimated location of the target 320, and the estimated extraction point of the submunition 100, and may also consider errors due to wind, target position, distinguishing target characteristics, and submunition sensor subsystem 116 capabilities. The delivery vehicle processor subsystem 220 may then communicate the proper time for deployment of the submunition orientation and stabilization system 126 to the submunition processor subsystem 134. A timer 128 in the submunition processor subsystem 134 may then measure elapsed time from submunition extraction to determine the proper deployment time of any orientation and stabilization system 126 on board the submunition 100.

The submunition orientation and stabilization system 126 may be mounted at one to end of the submunition 100, preferably the rear 154 of the submunition, to facilitate an effective deployment. In one embodiment of the invention, the orientation and stabilization system 126 is an air foil, which may be a samara blade or wing. Such a samara wing blade 140 (FIG. 6A) is described, for example, in U.S. Pat. No. 4,635,553 to Kane, assigned to the same assignee as this invention, and which is incorporated entirely herein by reference. A samara wing blade is also described in U.S. Pat. No. 4,583,703 to Kline which is also incorporated entirely herein by reference. The samara wing blade 140 may be deployed while the submunition 100 is spinning and may also maintain a specified spin rate of the submunition 100 after the samara wing blade 140 is deployed to continue submunition 100 stability and to allow the submunition sensor subsystem 116 on board the submunition to acquire the assigned military target 320. The samara wing blade 140 decelerates the submunition 100. Any down-range and cross-range velocity is substantially transferred to vertical motion to achieve a terminal velocity. Preferably before deployment of the orientation and stabilization system 126, the submunition 100 is aerostable and thus, aligns its principal axis, or spin axis X shown in FIG. 1, with the total velocity vector of the submunition 100 within approximately 5–10 seconds of free-fall flight after extraction from the delivery vehicle 200. Thus, the orientation and stabilization system housing 118 is at the trailing edge of the submunition 100. As the submunition 100 deploys the samara wing blade 140, the submunition 100 decelerates along its total velocity vector, and thus along the spin axis X.

In one embodiment of the invention, the submunition 100 has a spin rate of approximately 20–30 hertz, preferably approximately 22 hertz, and a terminal velocity of approximately 80 feet per second. Thus, the submunition 100 may make approximately one 360° rotational scan for each 2–4 vertical feet of movement of the submunition 100 in its flight. In another embodiment of the invention, the orientation and stabilization system 126 may be a parachute or balloon system to counteract the total velocity of the submunition 100. For example, a vortex ring parachute system may spin the submunition 100 at a rate of 7–8 hertz and achieve a terminal velocity of approximately 40–50 ft/s. Thus, the interlacing of the rotation and vertical movement of submunition 100 is approximately 6 feet per scan. Thus, the samara wing blade 140 is more efficient for deceleration and creates a better ratio of spin rate and terminal velocity to achieve a more effective interlacing of two to four feet per scan.

Figure 6A:
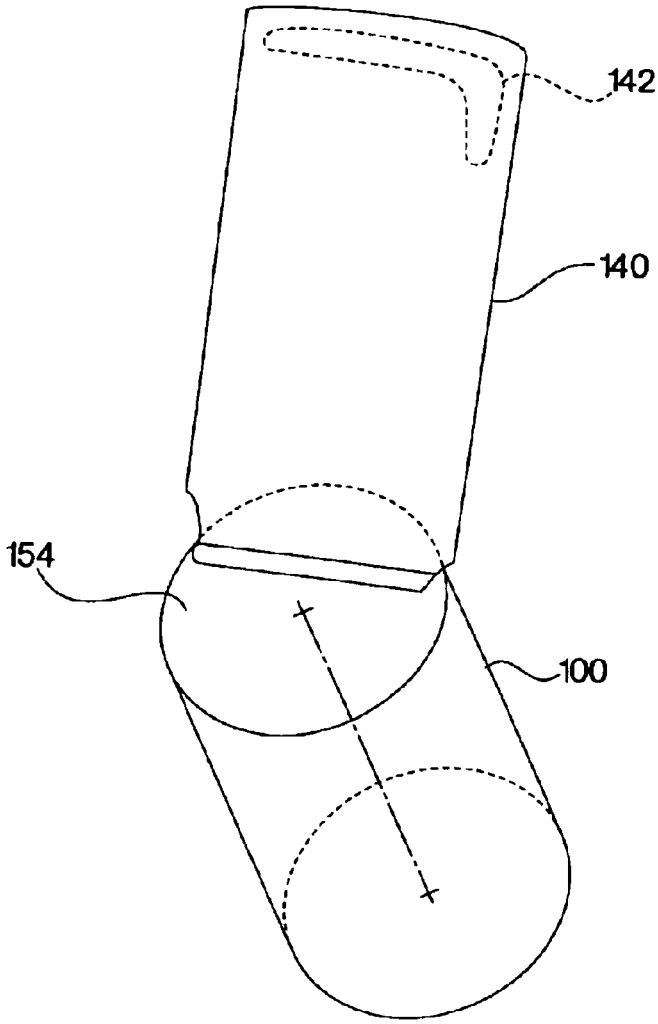
FIG. 6A is a perspective view of a submunition with a deployed orientation and stabilization system of the invention.

As shown in FIG. 6A, a samara wing blade 140 may be mounted at the rear 154 or downstream end of the submunition 100, such that when deployed, the submunition 100 may spin about its central axis as it descends downward, much like a maple seed falls from a tree. The samara wing blade 140 is preferably approximately 14 inches long and made of a flexible material. The samara wing blade 140 may be made from a woven, cloth-like material such as cotton or long-chain polyamides such as ARAMID™ or any suitable material such as polyester films including MYLAR® available from E.I. du Pont de Nemours. This flexible samara wing blade 140 has a weight 142 attached to its tip, and this weight 142 causes the samara wing blade 140 to be pulled taut due to the centripetal forces of the spinning submunition 100. Thus, the samara wing blade 140 behaves similar to a rigid blade. With blade twist induced by a properly designed wingtip and tip weight 142, the samara wing blade 140 pulls the submunition 100 around at a substantially constant spin rate in steady state. Due to the weight 142 incorporated in the wingtip, there may be a precession or wobble of the axis of the submunition 100 as the submunition 100 spins downward. This may expand the field of search of any onboard submunition sensor subsystem 116 and provide an enlarged sensor footprint.

During deployment, there is a tendency for the deploying tip weight to move outward in a straight line tangential with the arc of rotation of the submunition 100. Therefore, because the tip tends to move in a straight line while the submunition 100 rotates, there is a tendency for the samara wing blade 140 to twist about itself, i.e., experience torsion about its long axis, much like the twist seen in a propeller or in yarn. Also when the tip reaches the end of its travel there is a relatively large tension force applied to the bolts fastening the samara wing blade 140 to the submunition 100.

Figure 6B:
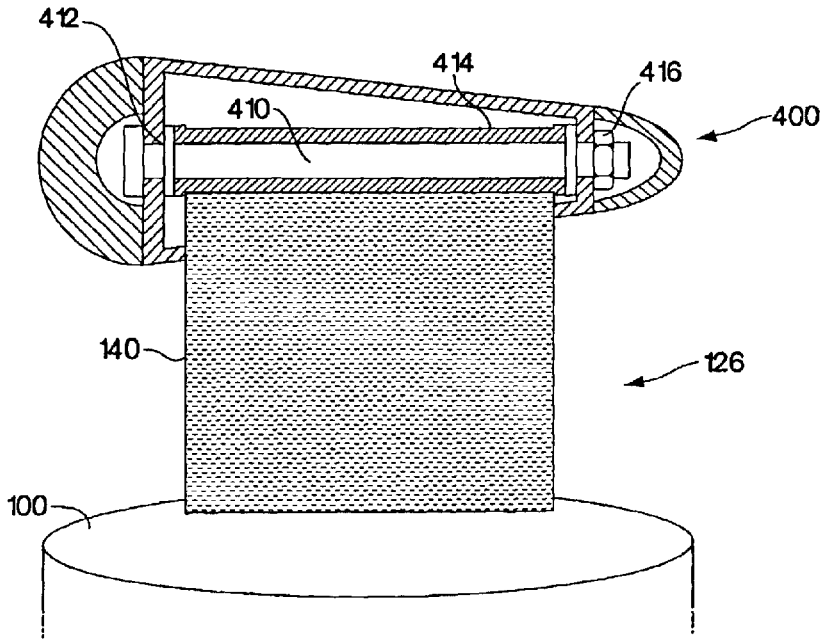
FIG. 6B is a cross-sectional view of one embodiment of a samara wing blade deployment system of the invention.

To counteract the tendency of the samara wing blade 140 to twist about itself during deployment, it is preferable that tension of the samara wing blade 140 be controlled over the time of deployment with a tension control device 400 shown in FIG. 6B. If the samara wing blade 140 is deployed too quickly, the submunition 100 may rotate faster than the samara wing blade 140, and the submunition 100 may flip over the samara wing blade 140 and fall into a flat spin, due to the samara wing blade 140 being flexibly attached to the submunition 100. In one embodiment of the invention, the samara wing blade 140 may be folded in storage in the submunition 100 and held together with rippable seams. During deployment, the seams holding the folds of the samara wing blade 140 may be ripped over time by the tension in the samara wing blade 140, allowing the samara wing blade 140 rotation to catch up to the rotation of the submunition 100, or in other words to sequentially slow down the rotation rate of the submunition 100 to match that of the samara wing blade 140. In an alternative embodiment of the invention, the samara wing blade 140 may be deployed with a cable system to control the time of deployment directly. Cables attached to approximately the one-quarter, the one-half, and three-quarter length points of the samara wing blade 140 may be cut or released periodically to sequentially deploy the samara wing blade 140. In another embodiment of the invention, a friction release device may feed out the samara wing blade 140 slowly over time to allow a better synchronization of the rotation rate of the samara wing blade 140 and the associated submunition 100.

Referring to FIG. 6B, a friction release device 400 is shown and includes a samara wing blade 140 wrapped around a shaft 410. At release, a friction disk 412 slowly unrolls the samara wing blade 140 over time and opposes the centripetal forces of the friction device and/or shaft acting as a tip weight 142. A spindle 414 may house the unrolled samara wing blade 140. The friction release device 400 may also include an adjustment device 416, which may be a nut. The nut may be rotated by a technician to adjust the frictional deployment parameters of the friction release device 400.

The submunition sensor subsystem 116 may scan the target area in a circular or conical pattern as the submunition 100 is spinning and losing altitude. A suitable microprocessor of the submunition processor subsystem 134 utilizes the signal from the submunition sensor subsystem 116 to detect the presence of the target 320 during the inward spiral scan. The delivery vehicle processor subsystem 220 communicates the assigned target and/or possible target characteristics to the submunition processor subsystem 134 before extraction. The communicated target characteristics may identify and/or distinguish the specified target 320 from the surrounding area or may provide general characteristics of a set of possible appropriate targets. Such target parameters may be a specified target at a particular location, and/or generic target parameters including energy radiation signatures, size, location, relative location, altitude, and shape. Thus, the submunition processor subsystem 134 may then compare information from the submunition sensor subsystem 116 with the specified target information as identified by the delivery vehicle processor subsystem 220 to determine if the detected target is a designated target 320 for the submunition 100.

The warhead 110 of the submunition 100 may be fuzed to detonate only after the submunition sensor subsystem 116 acquires a target as designated by the delivery vehicle processor subsystem 220 parameters communicated to the submunition processor subsystem 134. In a further embodiment of the invention, the submunition processor subsystem 134 may fuze the warhead 110 only after the submunition sensor subsystem 116 acquires a target and only after the acquired target is properly within range of the submunition 100. The submunition processor subsystem 134 may analyze the data from the submunition sensor subsystem 116 and may identify and/or distinguish an appropriate target from inappropriate targets such as civilian vehicles and the background. The submunition sensor subsystem 116 may include a safing and arming device 146 (FIG. 10) to prevent ignition of the warhead 110 until the safing and arming device 146 detects extraction of the submunition 100 through methods known in the art including, but not limited to, contact sensors, velocity and/or acceleration sensors, and proximity sensors. In a further embodiment, the safing and arming device 146 may not arm the warhead 110 until the submunition sensor subsystem 116 detects an appropriate target which is within range and aiming parameters. To initiate firing of the warhead 110, a precision initiator coupler 148 (FIG. 10) may be ignited upon detection of an appropriate target within range.

The submunition sensors and warhead assemblies are well-known in the art for sensor fuzed weapon technology. Such a sensor fuzed weapon is described, for example, in U.S. Pat. Nos. 4,356,770 to Atanasoff et al.; U.S. Pat. No. 4,635,553 to Kane; and Re 32,094 to Atanasoff, all assigned to the same assignee as this invention, and are incorporated entirely by reference herein. The submunition sensor subsystem 116 may be mounted in a submunition sensor housing 150 mounted on the outside of the submunition 100. Preferably, the housing 150 is mounted over 90 degrees, and preferably approximately 135 degrees away from the dovetail device 130 attaching the submunition 100 to the delivery vehicle 200. Alternatively, the submunition sensor subsystem 116 may be mounted inside the submunition 100.

In one embodiment, the submunition sensor subsystem 116 comprises a passive infrared detector and a laser profilometer. Alternatively or additionally, the submunition sensor subsystem 116 may include additional electro-optical sensor, a Global Positioning System receiver, a radar, LIDAR and/or a LADAR, particularly if the anticipated targets are stationary.

Figure 11:
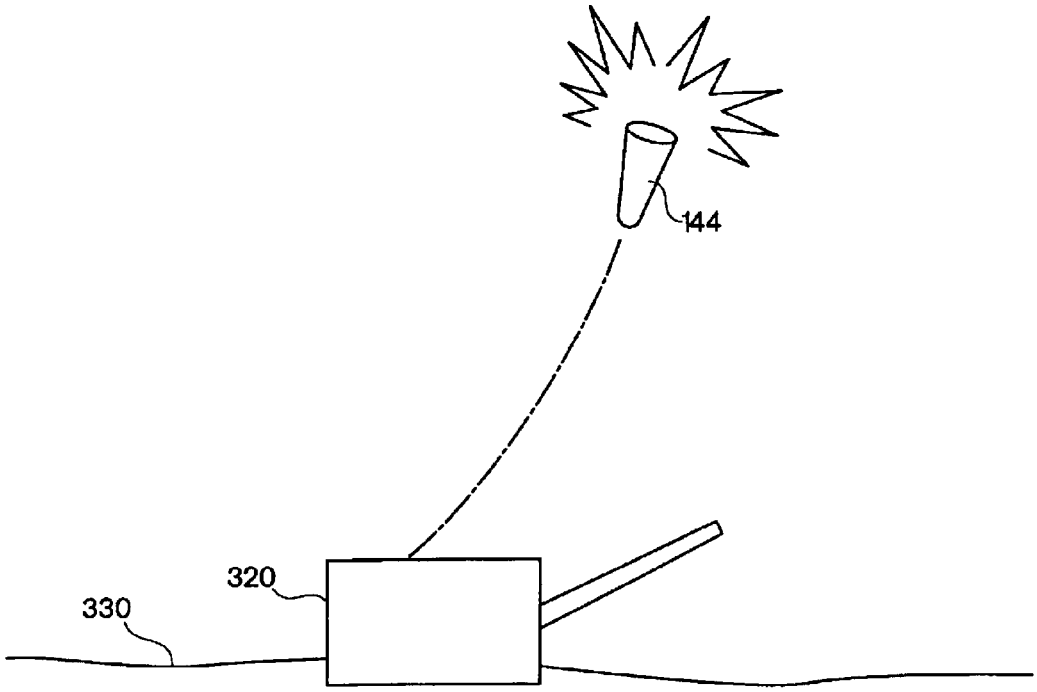
FIG. 11 is a plane view diagram schematically illustrating the flight path of an explosively formed projectile in one embodiment of the invention to intersect a specified target.

The warhead 110 may be an explosive charge designed to explode on impact or within a specific altitude. The warhead 110 may be solid or fragmentary and may carry its own explosive charge. Preferably, the warhead 110 may be an explosively formed projectile 144, and more preferably, an armor-piercing projectile as shown in FIG. 11. To form the explosively formed projectile 144, the warhead 110 may detonate when the submunition sensor subsystem 116 and/or the submunition processor subsystem 134 determines that the submunition 100 and, therefore, the warhead 110 is aimed at and within range of the target 320. The detonation force of the warhead 110 distorts a metal plate or disk 124, shown in FIG. 1, preferably mounted on the front 152 face of the cylindrical submunition 100 to explosively form a projectile 144 (shown in FIG. 11), which is preferably aero-stable, similar to a hollow bullet, so as to fly with a low angle of attack toward the target 320 and avoid the background 330. In one embodiment of the invention, the metal plate 124 may form a single projectile or multiple projectiles. Multiple projectiles may be formed from one main projectile with multiple smaller projectiles attached or formed around its perimeter. Those skilled in the art will recognize that many weapons and armaments are appropriate for submunition 100.

Figure 7:
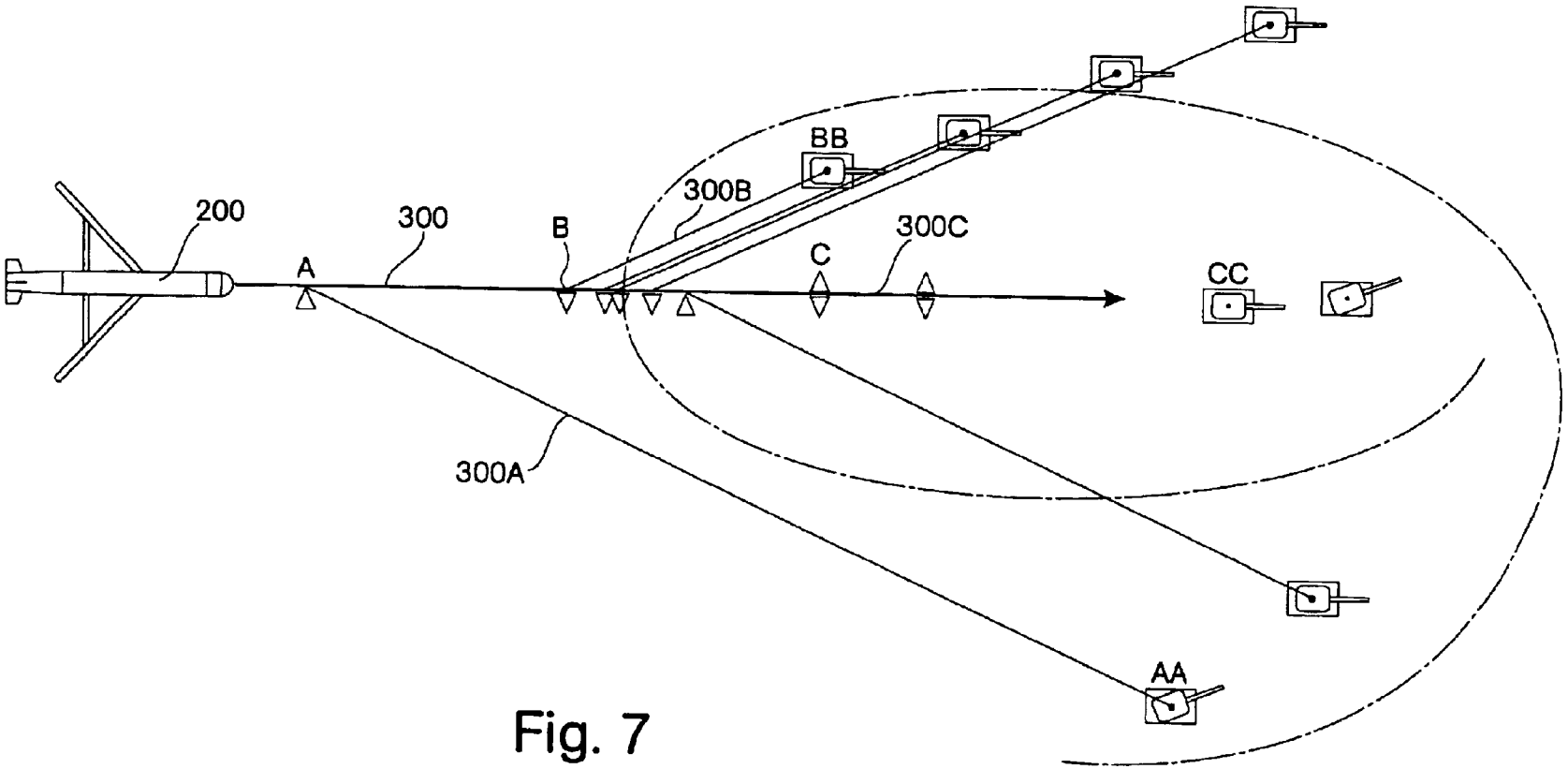
FIG. 7 is a plane view diagram schematically illustrating the flight path of the delivery vehicle and extraction and flight path of each submunition to intersect a specified target.

As shown in FIG. 7, the flight path 300 of the delivery vehicle 200 is substantially constant or alternatively may be guidable. Multiple submunitions 100 are self-extracted at different times along the flight path 300 of the delivery vehicle 200. Preferably, the extraction velocity and direction create a flight trajectory of the submunition 100 within 150 feet of the specified target to increase probability of submunition sensor acquisition. At point A on the flight path 300, a first submunition 100 is propelled to the right of the flight path 300. The resulting flight path 300A of the submunition 100 is the vector sum of the forward velocity of the delivery vehicle 200 and the velocity imparted to the submunition 100 by the extraction motor 112. The resultant flight path 300A moves off at a known angle from the delivery vehicle 200 toward the target 320. The delivery vehicle processor subsystem 220 may determine proper extraction point A for a submunition 100 to intersect a target AA which is forward and to the right of the extraction point A. At the extraction point B, a submunition 100 is deployed to the left of the flight path 300 to intersect the target BB to the left of the delivery vehicle flight path 300. However, target BB is not a maximum distance from the flight path 300 of the delivery vehicle 200. Thus, the submunition 100 preferably includes an orientation and stabilization system 126 that may counteract the lateral velocity and forward velocity imparted on the submunition 100 at extraction and allow the submunition 100 to drop down on a target that is substantially closer to the delivery vehicle 200 flight path 300 than the maximum delivery distance. A timer 128 may measure free flight time of the submunition 100 from extraction, and initiate the orientation and stabilization system 126 after a specified amount of time based on estimated velocity of the submunition 100 and location of the target relative to the submunition extraction. At point C on the flight path 300, the delivery vehicle 200 may propel a submunition 100 directly above the delivery vehicle 200, thus, imparting no lateral velocity to the submunition 100 other than that of momentum transfer from the forward flight path 300 of the delivery vehicle 200. Thus, targets such as target CC directly in line with the delivery vehicle flight path 300 may be reached by submunitions 100.

In one embodiment of the invention, a submunition 100 may be deployed from a delivery vehicle 200 by extracting the submunition 100 by a means other than an extraction motor 112. For example, the submunition 100 may be dropped or even released by a spring loaded mechanism. The submunition 100 may then be spun about the principal axis X and a submunition sensor subsystem 116 may be activated. A target 320 may then be acquired and a weapon or warhead 110 onboard the submunition 100 may be activated.

Having now described a few embodiments, it should be apparent to those skilled in the art that the foregoing is merely illustrative and not limiting, having been presented by way of example only. Numerous other embodiments and modifications may be made. For example, the delivery vehicle, itself, may be delivered to the target area with methods including rocket, missile, guided missile, and/or gun tube artillery.

What is claimed is:

1. A munition system comprising:

a delivery vehicle having a main portion; and at least two submunitions mounted within the main body portion, wherein each submunition has at least one extraction motor having at least one ejection port aligned with at least one flow through-port of the main body portion.

2. The munition system as claimed in claim 1, wherein at least one submunition includes an orientation and stabilization system.

3. The munition system as claimed in claim 2, wherein the orientation and stabilization system is a samara wing blade.

4. The munition system as claimed in claim 2, wherein each submunition further comprises a timer mechanism constructed and designed to be initiated at extraction of the submunition from the delivery vehicle.

5. The munition system as claimed in claim 4, wherein the submunition further comprises a submunition processor subsystem, the submunition processor subsystem communicating with the timer mechanism and initiating deployment of the orientation and stabilization system at a determined time from extraction.

6. The munition system as claimed in claim 5, wherein the delivery vehicle includes a delivery vehicle processor subsystem to determine the time to initiate deployment of the orientation and stabilization system and to communicate the determined time to the submunition processor subsystem.

7. The munition system as claimed in claim 1, wherein each submunition further comprises a spin-up system.

8. The munition system as claimed in claim 7, wherein the spin-up system is a second stage of the at least one extraction motor.

9. The munition system as claimed in claim 7, wherein the spin-up system includes at least two spin ports.

10. The munition system as claimed in claim 9, wherein the spin ports are diametrically opposed and aligned through a center of gravity of the submunition.

11. The munition system as claimed in claim 7, wherein the spin-up system is constructed and designed to spin-up the submunition to at least 20 hertz.

12. The munition system as claimed in claim 1, wherein the at least one ejection port is constructed and arranged to form a thrust vector through a center of gravity of the submunition.

13. The munition system as claimed in claim 1, wherein the extraction motor of each submunition includes at least three ejection ports and at least one ejection port is aligned with at least one through-port of the main body portion.

14. The munition system as claimed in claim 13, wherein at least one through-port is an opening in the main body portion for extraction of the submunition.

15. The munition system as claimed in claim 13, wherein the main body portion includes at least three through-ports.

16. The munition system as claimed in claim 13, wherein the ejection ports are constructed and arranged to extract the submunition to the left, right and upward of the delivery vehicle.

17. The munition system as claimed in claim 16, wherein the at least three ejection ports include a first ejection port constructed and arranged to thrust approximately vertically and downward of the delivery vehicle, a second ejection port constructed and arranged to thrust approximately 45 degrees from the first ejection port, and a third ejection port constructed and arranged to thrust approximately 45 degrees from the first ejection port.

18. The munition system as claimed in claim 1, wherein each ejection port is substantively sealed with an explosive plug, wherein at least one plug is explosively opened to allow the extraction motor to thrust through the at least one ejection port and the at least one through-port.

19. The munition system as claimed in claim 18, wherein the explosive plug includes a phototransistor explosive initiator constructed and designed to be actuated by a laser pulse.

20. The munition system as claimed in claim 1, wherein the delivery vehicle further comprises a delivery vehicle processor subsystem to determine errors due to wind.

21. The munition system as claimed in claim 1, wherein the delivery vehicle further includes a delivery vehicle sensor subsystem and a delivery vehicle processor subsystem to determine target position.

22. The munition system as claimed in claim 21, wherein the delivery vehicle processor subsystem determines at least one ejection port to initiate to target at least one submunition to the determined target position.

23. The munition system as claimed in claim 1, wherein the delivery vehicle further includes a delivery vehicle sensor subsystem and a delivery vehicle processor subsystem to determine distinguishing characteristics of a target.

24. The munition system as claimed in claim 23, wherein the delivery vehicle processor subsystem discriminates between military and civilian targets.

25. The munition system as claimed in claim 1, wherein each submunition further includes at least one submunition sensor subsystem adapted to detect a military target.

26. The munition system as claimed in claim 25, wherein the at least one submunition sensor subsystem communicates with a submunition processor subsystem to compare distinguishing target characteristics.

27. The munition system as claimed in claim 26, wherein the delivery vehicle further includes a delivery vehicle sensor subsystem and a delivery vehicle processor subsystem to determine distinguishing characteristics of a target, the delivery vehicle processor subsystem communicating the distinguishing characteristics of the target to the submunition sensor subsystem of the submunition before extraction of the submunition from the delivery vehicle.

28. The munition system as claimed in claim 1, wherein at least one extraction motor is designed to eject a submunition at at least 100 feet per second lateral velocity from the delivery vehicle for a twelve pound submunition.

29. The munition system as claimed in claim 1, wherein each submunition is removably attached to the delivery vehicle with a dovetail device.

30. The munition system as claimed in claim 29, wherein the dovetail device is designed to be sheered by the forces of the extraction motor.

31. The munition system as claimed in claim 30, wherein the dovetail device is a friction lock designed to release the submunition under the force of the extraction motor.

* * * * *

UNITED STATES PATENT AND TRADEMARK OFFICE

CERTIFICATE OF CORRECTION

PATENT NO. : 6,834,593 B2
APPLICATION NO. : 10/643433
DATED : December 28, 2004
INVENTOR(S) : Ralph L. Nardone et al.

It is certified that error appears in the above-identified patent and that said Letters Patent is hereby corrected as shown below:

In the Claims:
Claim 1 should read:
1. A munition system comprising:
a delivery vehicle having a main body portion; and
at least two submunitions mounted within the main body portion, wherein each submunition has at least one extraction motor having at least one ejection port aligned with at least one flow through-port of the main body portion.

Signed and Sealed this

Twenty-first Day of October, 2008

JON W. DUDAS
*Director of the United States Patent and Trademark Office*

UNITED STATES PATENT AND TRADEMARK OFFICE

CERTIFICATE OF CORRECTION

PATENT NO. : 6,834,593 B2
APPLICATION NO. : 10/643433
DATED : December 28, 2004
INVENTOR(S) : Ralph L. Nardone et al.

It is certified that error appears in the above-identified patent and that said Letters Patent is hereby corrected as shown below:

Column 14, lines 28-34,
In the Claims:
Claim 1 should read:
1. A munition system comprising:
a delivery vehicle having a main body portion; and
at least two submunitions mounted within the main body portion, wherein each submunition has at least one extraction motor having at least one ejection port aligned with at least one flow through-port of the main body portion.

This certificate supersedes the Certificate of Correction issued October 21, 2008.

Signed and Sealed this

Eleventh Day of November, 2008

JON W. DUDAS
*Director of the United States Patent and Trademark Office*